United States Patent [19]

Borel

[11] Patent Number: 4,702,952

[45] Date of Patent: Oct. 27, 1987

[54] SHEET FORMING FABRIC WITH REINFORCED MARGINS

[75] Inventor: Georg Borel, Reutlingen, Fed. Rep. of Germany

[73] Assignee: Hermann Wagner GmbH & Co. KG, Reutlingen, Fed. Rep. of Germany

[21] Appl. No.: 819,552

[22] Filed: Jan. 17, 1986

[30] Foreign Application Priority Data

Jan. 22, 1985 [DE] Fed. Rep. of Germany ..... 3501980

[51] Int. Cl.[4] ..... D21F 1/10; B32B 23/02; D03D 15/00

[52] U.S. Cl. ..... 428/193; 428/88; 162/348; 162/DIG. 1; 139/383 A

[58] Field of Search ..... 162/353, 348, DIG. 1; 428/88, 284, 234, 193; 139/383 A

[56] References Cited

U.S. PATENT DOCUMENTS 4,119,753 10/1978 Smart ..... 428/234
4,564,051 1/1986 Odenthal ..... 162/348 X

FOREIGN PATENT DOCUMENTS 2922025 12/1979 Fed. Rep. of Germany ... 162/DIG. 1

*Primary Examiner*—Peter Chin
*Assistant Examiner*—Thi Dang
*Attorney, Agent, or Firm*—Sughrue, Mion, Zinn, Macpeak and Seas

[57] ABSTRACT

A sheet forming fabric with reinforced margins is provided on its backing side with a fabric strip in the marginal regions. The fabric strip can have a double layer structure with transverse threads arranged at least partially in pairs one over the other and with longitudinal threads. The fabric strip has a pronounced longitudinal filament structure on the backing side and is fastened to the fabric by stitching. The sewing thread takes the place of a longitudinal thread of the fabric strip previously removed from or omitted during weaving of the fabric.

3 Claims, 2 Drawing Figures

SHEET FORMING FABRIC WITH REINFORCED MARGINS

BACKGROUND OF THE INVENTION

The invention relates to a sheet forming fabric with reinforced margins.

In papermaking machines sheet forming fabrics are used for dehydrating the paper pulp. The sheet forming fabrics have a limited service life because on the backing side they are worn by friction against stationary dehydrating means of the papermaking machine. Such wear is enhanced by abrasive fillers which are added in a proportion of 20 to 22% by weight to the paper pulp in the manufacture of printing paper. Initially the sheet forming fabrics are worn only locally in the marginal zones. Frequently sheet forming fabrics show wear in the main ares of only 25 to 30% while in the marginal regions a narrow strip of 2 to 5 cm width is already completely worn through so that the fabric must be removed from the papermaking machine. These strips which are subject to especially high wear are located a distance of 6 to 18 cm inwardly from the edge of the sheet forming fabric. The cause for such locally concentrated high wear has not yet been completely discovered. In papermaking machines of conventional construction, i.e., those using a sheet forming Fourdrinier fabric, it is presumed that the cause for increased wear resides in the geometry of the openings of the suction boxes, in the vacuum distribution across the fabric width, and the like. Twin wire formers manufactured according to the most recent construction principles are seldom equipped with stationary suction boxes but exhibit the same unfavorable wear phenomena with highly concentrated wear along the marginal zones.

Various ways have been devised to prevent such unequal wear. From U.S. Pat. No. 4,011,131, it is known to provide a slot along the front edge of the suction boxes through which lubricant fluid, e.g., water, can be introduced into the friction area between the sheet former and the suction box. However, this method was not successful since, due to the high contact pressure in the region of the suction boxes, the water does not get into the marginal zones that are subject to wear. Also, relatively small amounts of water cannot prevent wear caused by the nearly ever present quartz particles.

U.S. Pats. Nos. 2,523,867, and 3,652,390, propose to adhere highly tenacious longitudinal filaments embedded into a synthetic resin composition or to fill the longitudinal strip along the marginal regions with a synthetic resin composition. However, this renders the marginal regions impervious, so that in these regions the pulp is not dehydrated. The pulp is then thrown off at the egoutteur or dandy roller, so that efficient quality production becomes impossible.

From German Offenlegungsschrift No. 2,922,025, it is known to stitch the fabric in the longitudinal direction in the marginal regions susceptible to wear on the backing side with an abrasion resistant yarn. However, it was found that the portion of the yarn disposed inside the fabric is not effective whereas the portion of the swing yarn disposed outside the fabric is soon worn through due to the high friction.

Moreover, sheet forming fabrics are known in which additional thick longitudinal threads are interwoven along the margins during weaving of said fabrics to increase the abrasion resistance. Said longitudinal threads have long floatings and a greater diameter than the structural threads of the fabric. Initially the marginal region of the sheet forming fabric slides on said additional longitudinal threads. However, since they protrude from the fabric plane as individual threads, they are worn after a relatively short time so that the fabric proper soon comes into contact with the machine parts. At the sites where said additional thick longitudinal threads are woven into the structure of the sheet forming fabric the transverse threads are deformed far outside the normal fabric plane owing to the unusually large diameter of the additional longitudinal threads, so that they, too, are soon worn through. After said transverse threads are worn through the marginal zone of the sheet forming fabric is very quickly destroyed.

SUMMARY OF THE INVENTION

The invention has the object to to provide a sheet forming fabric in which a reduction of the lifetime due to increased wear in the marginal zones is prevented or at least delayed. This object is realized by applying a fabric strip on the backing side in the marginal zones.

The fabric strip can be a single layer or, in a preferred embodiment, a double layer fabric. Furthermore, in order to reduce friction against the machine parts, the fabric strip has a pronounced longitudinal thread structure, i.e., the backing side of the fabric strip exclusively consists of longitudinally oriented floatings of the longitudinal threads, while the transverse threads are disposed far deeper in the fabric, i.e., they do not form the external surface.

The fabric strip is produced preferably with omitted stitching lanes on a ribbon loom. In general, the fabric strips have a width of only 8 to 20 cm, while the sheet forming fabric has a width of 5 to 10 meters.

The additional fabric strip can be connected to the fabric proper in various ways, e.g., by adhesion. It is also possible to weave the fabric strip jointly with the sheet forming fabric and in this case it is suitably connected thereto by a binder warp. However, preferably it is connected to the fabric by stitching. To this end one or more longitudinal threads are omitted from the strip during weaving on a ribbon loom or are removed afterwards along the additional fabric strip, so that at these sites the two fabrics can be stitched together with a conventional technical sewing machine. The vacant sites form longitudinally extending grooves into which the sewing thread can be placed. Especially in the case of a pronounced longitudinal filament structure the sewing thread is then disposed so deep in the fabric interior that it is not exposed to wear against the machine parts.

The advantages attainable by the invention especially reside in the fact that on the backing side of the fabric strip there are no individual floatings which project and are then worn through before long by the sharp edges of the dehydrating means and form instead a uniform longitudinally oriented coarse fabric structure. The additional fabric strip does not substantially obstruct dehydration in the marginal areas. Therefore, the papermaking machine can be started in the usual way in that first only a narrow paper strip is passed from the fabric edge through the further stations of the machine and, when said marginal strip has reached the windup means at the end of the papermaking machine, it is widened until finally the full width of the paper sheet passes through the machine.

When the additional fabric strip has been largely worn after some time, it can be easily removed from the fabric proper by severing the sewing threads between the two fabrics. From then on the still intact basic fabric in the marginal regions is available for wear.

The fabric strip is made from multifilament or preferably from monofilament synthetic resin threads. The fabric strip should be readily elongatable and therefore is woven from a high elongation type of wire as used, for example, for the weft wire of conventional Fourdrinier wires or fabrics. Polyester and polyamide receive special consideration as the material for the synthetic threads of the fabric strip. Since the fabric is to be extensible to allow for extension to a degree similar to that of the Fourdrinier fabric, the fabric strip, if produced separately from the Fourdrinier fabric, is not extended during thermosetting.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
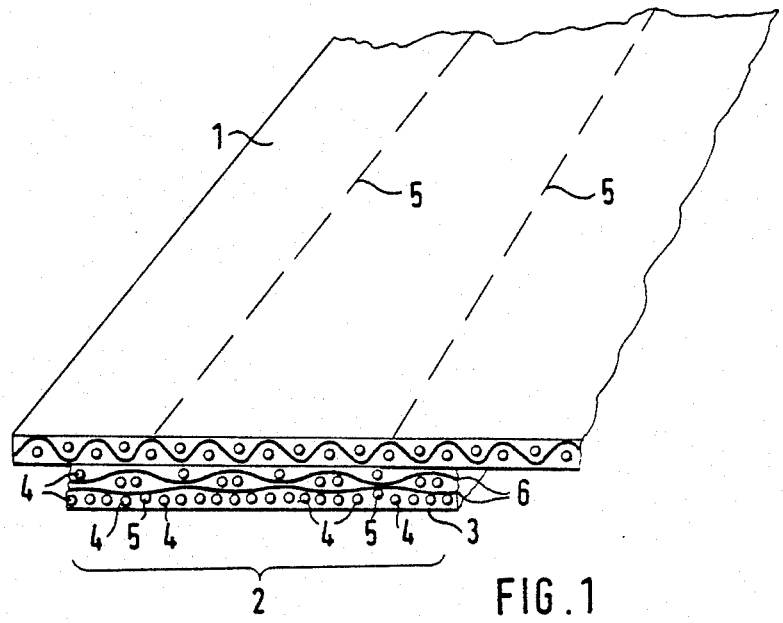
FIG. 1 is a partial perspective view of a sheet forming fabric with the additional fabric strip shown in cross section.

Viewed obliquely from above and in section, FIG. 1 shows a sheet forming fabric which is a Fourdrinier fabric 1 of a conventional type provided on the backing side with an additional fabric strip 3 in the marginal region 2. The fabric strip 3 is spaced several centimeters from the lateral edge of the fabric 1 and has a width of 8 to 20 cm. It is connected to the endless sheet forming fabric by means of a sewing thread 5 indicated in FIG. 1 by a broken line.

Figure 2:
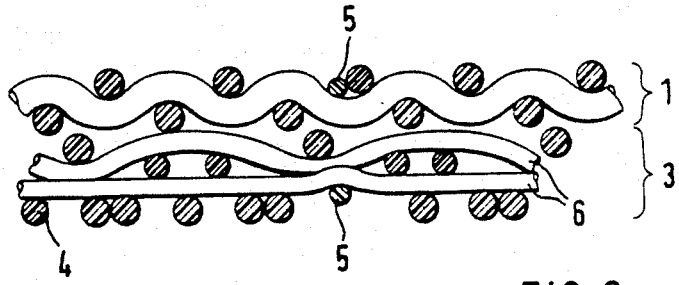
FIG. 2 is an enlarged sectional view of FIG. 1.

FIG. 2 shows an enlarged section across the fabric 1 with the fabric strip 3 secured thereto. While the fabric 1 is shown only schematically, the drawing shows that the fabric strip 3 has a double layer structure with two layers of transverse threads 6 interwoven with a system of longitudinal threads 4. The fabric strip 3 is of such a weave that its backing side is formed exclusively by the longitudinal threads 4, so that the lower transverse threads 6 are only subject to wear after the longitudinal threads 4 on the underside are virtually completely worn through. In synthetic resin sheet forming fabrics and also in the fabric 1 shown in the drawing, the backing side is normally formed by the transverse threads. The backing side of the fabric strip 3, however, has a pronounced longitudinal thread structure. The pronounced longitudinal thread structure on the backing side of the fabric strip reduces abrasion.

The fabric strip 3 is secured to the fabric 1 by sewing threads 5. The sewing threads 5 have a smaller diameter than the longitudinal threads 4 and are thus not exposed to wear.

Like the backing side of the fabric 1, the top side of the fabric strip 3 has a pronounced transverse thread structure, so that these two facing fabric sides virtually mesh with one another.

In operation a sheet forming fabric is highly extended in the longitudinal direction by the great tension to which it is subjected. At the same time this causes the sheet forming fabric to shrink in width. In two layer fabrics the binder threads must transmit great forces to the top layer so that it elongates together with the bottom layer. Since both fabric layers are normally subject to differential transverse contraction at equal elongation, this results in high friction between the two fabric layers, so that occasionally higher wear occurs in the interior of the fabric than on the backing side. As a result of such wear, the binder filaments are crushed and abraded so that the two fabric layers separate and the sheet forming fabric becomes useless.

In the sheet forming fabric of the invention the fabric strip 3 is of small width so that in said fabric strip 3 itself, no appreciable transverse contraction occurs under tensile stress. Moreover, the driving power is transmitted directly to the fabric 1, so that the sewing threads 5 connecting the fabric 1 to the fabric strip 3 are not subject to high shearing action.

EXAMPLE

The sheet forming fabric consists of a double-layer cloth with a seven harness weave in which each warp wire passes over two weft wire pairs, then between one pair of weft wires, thereafter under one pair of weft wires, and finally between three pairs of weft wires. In the subsequent weave pattern the same course is repeated and the distribution of the warp wires corresponds to a satin weave with a counter of three.

Sixty warp wires per centimeter having a diameter of 0.17 mm are woven with twenty-four pairs of weft wires per centimeter having a diameter of 0.18 mm in the upper layer, and 0.20 mm in the lower layer. The warp wires are low-elongation polyester monofilaments, while the weft wires of the upper layer are soft and readily deformable polyester monofilaments. The same material is used for every second weft wire on the backing side, while the other weft wires in the backing layer consist of polymide.

The fabric strip additionally applied in the marginal regions is of eight harness, doubly layer weave. The warp wires pass below five pairs of weft wires, then between one pair of weft wires, then over one pair of weft wires, and finally between one pair of weft wires. The warp wires are distributed in a satin weave with a counter of three.

The warp wires of the fabric strip are polyester monofilaments of a readily extensible type, like that normally used as weft material, and have a diameter of 0.2 mm. The warp density is forty-six per centimeter. For the weft wires a readily extensible polyester type of 0.18 mm diameter is used. The pickage is eighteen wire pairs per centimeter.

In contrast to the fabric, the fabric strip is thermoset in relaxed condition in order that it may elongate without any resistance together with the fabric in operation when subjected to tensile stress, and does not substantially affect the elongation properties of the fabric in the marginal regions.

The fabric strip is stitched onto the completely finished fabric in the stretching machine at low speed. The fabric is stretched between two rollers of the finishing machine and slowly advances in a longitudinal direction during stitching. The fabric strip has as width of 16 cm, and four warp wires are left out in uniform distribution across said width. The sewing thread is placed into the groove left by the absent warp wires. Edge sensors ascertain that the seam extends precisely along the groove. The seam track is monitored by video cameras so that the operator can watch the sewing machine on monitor screens in large magnification and can correct the operation thereof, if necessary.

While the invention has been particularly shown and described with reference to preferred embodiments thereof it will be understood by those in the art that the foregoing and other changes in form and details may be made therein without departing from the spirit and scope of the invention.

What is claimed is:

1. A sheet forming fabric with reinforced margins comprising a forming fabric and at least one elongated fabric strip woven from thread secured to the non forming side of said forming fabric parallel to the edge of said forming fabric, said fabric strip having a double layer structure with transverse threads arranged at least partially in pairs one over the other and with longitudinal threads interwoven with said at least partially in pairs one over the other and with longitudinal threads interwoven with said transverse threads such that the contact surface of the strip exclusively consists of longitudinally oriented floatings of the longitudinal threads.

2. A sheet forming fabric according to claim 1, wherein said fabric strip is fastened to the forming fabric by a sewing thread.

3. A sheet forming fabric according to claim 2 wherein said sewing thread takes the place of at least one longitudinal thread of the fabric strip previously removed from or omitted during weaving of the fabric.

* * * * *